US010950115B2

(12) United States Patent
Witkowski

(10) Patent No.: US 10,950,115 B2
(45) Date of Patent: Mar. 16, 2021

(54) OVERHEAD DOOR SPRING MALFUNCTION DETECTION AND NOTIFICATION

(71) Applicant: GENTEX CORPORATION, Zeeland, MI (US)

(72) Inventor: Todd R. Witkowski, Zeeland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 16/654,441

(22) Filed: Oct. 16, 2019

(65) Prior Publication Data

US 2020/0126392 A1 Apr. 23, 2020

Related U.S. Application Data

(60) Provisional application No. 62/749,293, filed on Oct. 23, 2018.

(51) Int. Cl.

| | |
|---|---|
| ***G08B 21/00*** | (2006.01) |
| ***G08B 21/18*** | (2006.01) |
| ***G08B 7/06*** | (2006.01) |
| ***E05F 15/60*** | (2015.01) |

(52) U.S. Cl.

CPC ..... *G08B 21/182* (2013.01); *E05F 15/60* (2015.01); *G08B 7/06* (2013.01); *E05Y 2900/106* (2013.01)

(58) Field of Classification Search

CPC ..... G08B 21/182; G08B 7/06; E05F 15/60; E05F 15/668; E05F 15/00; E05F 15/77; E05F 15/76; E05F 15/684; E05Y 2900/106; E05Y 2400/822; E05Y 2400/814; E05Y 2400/506; E05Y 2400/334; E05Y 2400/514; E05Y 2201/488; E05Y 2201/484; E05Y 2400/458; E05Y 2400/31; E05D 13/1269; E05D 13/1215; E05D 13/1261

USPC ..... 340/679, 665, 668; 49/197, 199, 200

See application file for complete search history.

(56) References Cited

U.S. PATENT DOCUMENTS

| | | | | |
|---|---|---|---|---|
| 6,624,605 | B1 * | 9/2003 | Powder | G07C 9/00182 318/16 |
| 2008/0224642 | A1 * | 9/2008 | Rodriguez | E05F 15/70 318/466 |
| 2010/0019916 | A1 * | 1/2010 | Jankovsky | E05D 13/1269 340/679 |
| 2010/0117578 | A1 * | 5/2010 | Hollenbeck | E05F 15/668 318/461 |
| 2011/0032073 | A1 * | 2/2011 | Mullet | E05F 15/668 340/5.7 |
| 2017/0359555 | A1 * | 12/2017 | Irani | H04L 67/146 |

* cited by examiner

*Primary Examiner* — Anh V La

(74) *Attorney, Agent, or Firm* — Price Heneveld LLP; Bradley D. Johnson

(57) ABSTRACT

A system for detecting broken springs in overhead doors having automatic door openers includes an automatic door opener having a motor, a sensor configured to monitor performance of the motor in the door opener, and a processor in communication with the sensor. The processor is configured to compare the motor performance with a predetermined threshold level and send an alert when motor performance exceeds the predetermined threshold level.

9 Claims, 5 Drawing Sheets

OVERHEAD DOOR SPRING MALFUNCTION DETECTION AND NOTIFICATION

FIELD OF THE INVENTION

This disclosure relates generally to the detection of broken springs in overhead doors and, in particular, to a system that detects a broken spring and notifies the user.

BACKGROUND

Overhead doors such as garage doors may weigh several hundred pounds and may be difficult to lift manually. Thus, most overhead doors have springs to assist with lifting the door. The springs are generally of one of two types: torsion springs and extension springs.

Torsion springs generally extend along a torsion rod above an overhead door. One end of a torsion spring is typically fastened to a stationary plate. The other end is then wound axially around the torsion rod a set number of rotations and secured to the torsion rod. A cable extends from a drum on one end of the torsion rod to a bracket secured to the overhead door. As the door opens, the torsion spring unwinds, turning the drum, and winding the cable onto the drum, thereby assisting in lifting the weight of the door. Similarly, as the door closes, the torsion spring rewinds, thereby assisting in controlling the descent of the overhead door.

Extension springs generally extend from a ceiling-mounted bracket to a system of pulleys and cables. A cable extends from a pulley to a bracket secured to the overhead door. As the overhead door opens, the extension spring compresses, assisting in lifting the weight of the door. Similarly, as the door closes, the spring extends, assisting in controlling the descent of the overhead door.

Both extension springs and torsion springs can be expected to last several years or even decades without breaking. When a spring does break, it is unlikely that an overhead door opener will be able to lift the weight of the door. Since the springs break so seldom, when one does break, a user may not know why the automatic door opener no longer opens the overhead door. The user may suspect that the problem lies within the automatic door opener and may attempt to repair or replace it. More importantly, if a spring breaks when an overhead door is in an open position and a user tries to close the door, the door may fall, and may crush whatever lies in its path. This can cause injury, damage, or death.

Therefore, there is a need for a system for alerting users to broken overhead door springs.

SUMMARY

According to some embodiments, a system for detecting breakage of a spring in overhead doors equipped with automatic door openers comprises an automatic door opener having a motor; a sensor configured to monitor motor performance; and a processor in communication with the sensor; wherein the processor is configured to compare motor performance to a predetermined threshold motor performance level. The processor may be configured to communicate with an external device when motor performance exceeds the threshold performance. The external device may comprise one of a vehicle rearview assembly, a smartphone, a controller, a laptop computer, a home security system, and a tablet computer, as shown in FIG. 4. The processor may communicate wirelessly.

According to some embodiments, a system for detecting broken springs in overhead doors having automatic door openers with motors comprises an automatic door opener having a motor; a sensor in communication with the motor; a processor in communication with the sensor; and a controller; wherein the processor is configured to communicate with the controller. The sensor may be configured to monitor a load on the motor; the processor may be configured to compare the load on the motor with a predetermined threshold level; and the processor may send a signal to the controller when the load on the motor exceeds the predetermined threshold level. The controller may be configured to display a message when the controller receives the signal indicating the motor loading has exceeded the predetermined threshold level. The controller may have a display screen; and upon receipt of the signal indicating that the motor loading has exceeded the predetermined threshold level a message may be displayed on the display screen. The controller may be one of a rearview assembly, a smart phone, a tablet computer, and a laptop computer.

According to some embodiments, a method of sending an alert when a door spring breaks comprises the steps of providing a sensor configured to monitor performance of a door opener motor; a processor in communication with the sensor; and a controller; monitoring the motor performance with the sensor; comparing the motor performance with a predetermined threshold level; and sending, when the motor performance exceeds the predetermined threshold level, an alert. The alert may be sent to the controller. The controller may be one of a rearview assembly, a wall-mounted or stand-alone unit, a tablet or laptop computer, or a smartphone. The method may further comprise the step of displaying at least one of text and graphics to assist a user in diagnosing a cause of the motor exceeding the predetermined threshold level. The controller may have a display screen; the method may further comprise the step of displaying a message on the display screen when the controller receives the alert. The controller may have a speaker; the method may further comprise the step of providing, upon receipt of the alert, an audible signal through the speaker. The signal may be sent in one of wirelessly, through wi-fi or radio waves, through Bluetooth, or through wired or wireless internet

DETAILED DESCRIPTION

Figure 1:
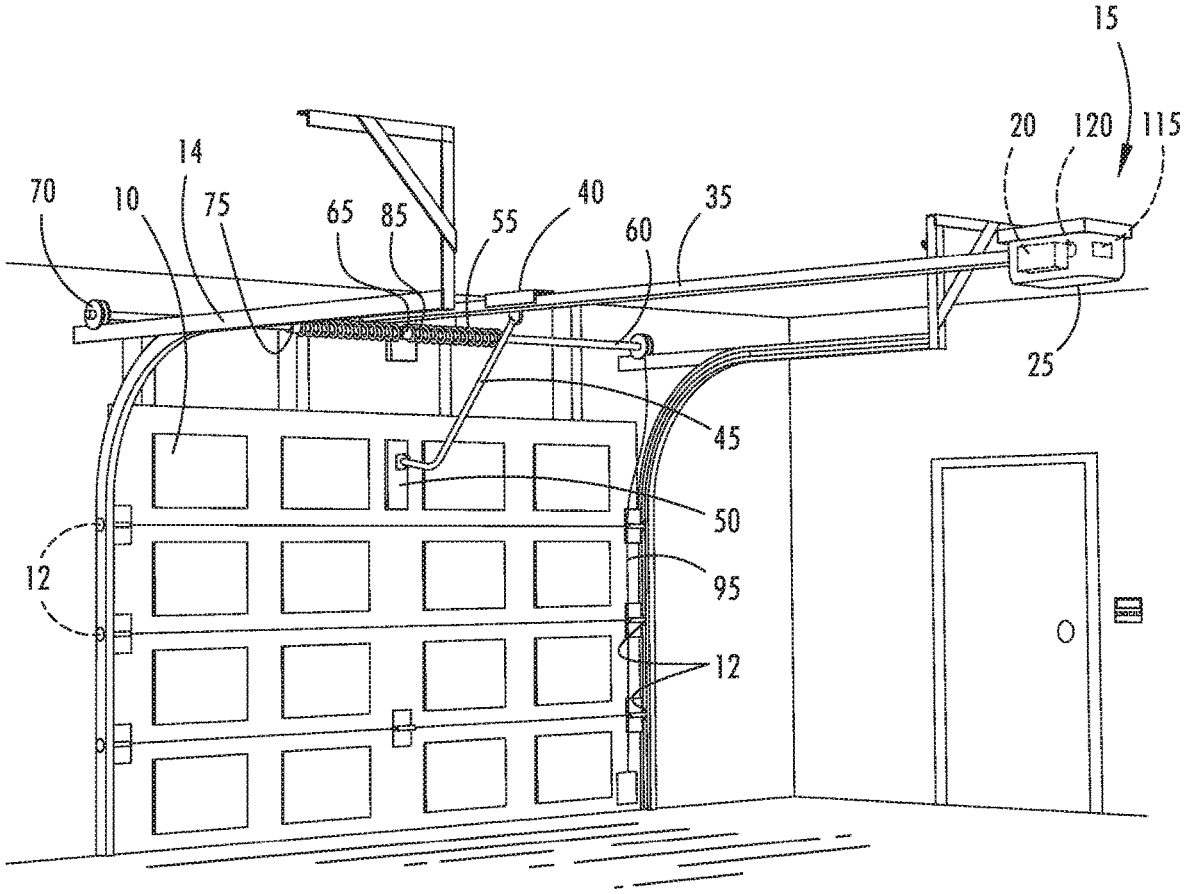
FIG. 1 illustrates a system to detect broken torsion springs in overhead doors in accordance with the present disclosure.

Reference will now be made in detail to the present embodiments of the disclosure, examples of which are illustrated in the accompanying drawings. In the drawings, the depicted structural elements are not to scale and certain components are enlarged relative to the other components for purposes of emphasis and understanding.

The terms "including," "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. An element preceded by "comprises . . . a" does not, without more constraints, preclude the existence of additional identical elements in the process, method, article, or apparatus that comprises the element.

Figure 2:
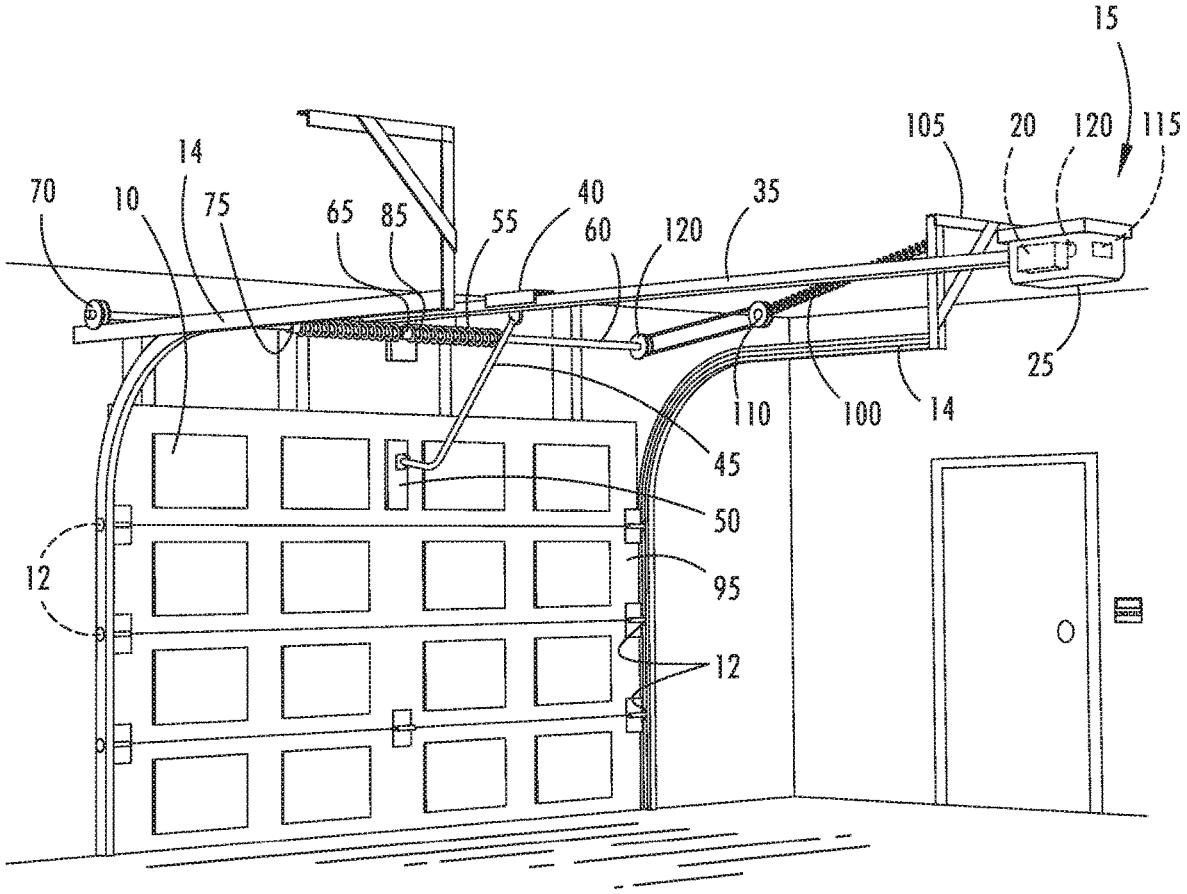
FIG. 2 illustrates a system to detect broken extension springs in overhead doors in accordance with this disclosure.

Referring now to FIGS. 1 and 2, overhead door 10 may be shown generally at 10. Overhead door 10 may be operable to open and close. A plurality of rollers 12 may be disposed along each side of overhead door 10. The plurality of rollers 12 may be capable of moving along tracks 14 as overhead door 10 opens and/or closes. Tracks 14 may include a generally vertical portion that rollers 12 occupy when door 10 is closed, a generally horizontal portion that the rollers occupy when the door is open, and a curved portion extending therebetween. Overhead door 10 may have at least one torsion spring 55 or at least one extension spring 100 to assist in opening and closing the door.

In overhead doors which employ torsion springs to help lift and to control the descent of overhead doors, overhead door 10 may have at least one torsion spring 55 mounted to a torsion rod 60. Torsion rod 60 may be disposed above and extend generally parallel to the top edge of overhead door 10. The at least one torsion spring 55 may have a stationary cone 65 at a first end of torsion rod 60 and a winding cone 75 at a second end. Stationary cone 65 may be secured to a center bearing plate 85. Winding cone 75 may be secured to torsion rod 60 to allow torsion rod to rotate as overhead door opens or closes. Torsion spring 55 may be wound a set number of rotations prior to winding cone 75 being secured to torsion rod 60.

As the torsion rod rotates as overhead door 10 opens or closes, a drum 70 at each end of torsion rod 60 rotates. A cable 95 having a first end secured to drum 70 and a second end secured to overhead door 10 may be wound on drum 70 when overhead door opens helping to lift the overhead door, and may unwind from drum 70 when overhead door closes, controlling the descent of the door.

In overhead doors having extension springs, a plurality of extension springs assist in opening and closing the door. One end of each extension spring 100 may be secured to a ceiling mounted bracket 105. A second end of each extension spring 100 may be secured to a first pulley 110. A cable may extend around first pulley 110, over a stationary pulley 120, and to a bracket secured to a surface of overhead door 10.

Overhead door 10 may have an automatic door opener 15 disposed to open and close overhead door 10 automatically. Automatic door opener 15 may have a motor 20 in a housing 25. In some embodiments, a chain or belt 28 may extend from the housing along a track 35. In some embodiments, a screw drive (not shown) may extend from the housing along track 35. Track 35 may end near the wall in which the overhead door is located. A trolley 40 may be secured to the screw, chain or belt 28, and may be configured to move along track 35. If door 10 is in an open position, trolley 40 may be disposed near the end of track 35 near automatic door opener housing 25, and if door 10 is in a closed position, trolley 40 may be disposed in the end of track 35 near the wall on which the overhead door is located. A first end of a door arm 45 may be removably secured to trolley 40. A bracket 50 may be secured to a surface of the overhead door 10, and a second end of door arm 45 may be attached to the bracket 50.

Automatic door opener 15 may include at least one controller 80. Controller 80 may be configured to receive a user input, and the user input may include instructions to open or close overhead door 10. Controller 80 may be a wall-mounted or stationary controller 80*a*, a stand-alone or portable controller 80*b* configured to, for example, be carried on a keyring or secured to a vehicle visor, or an in-vehicle controller 80*c* disposed within a portion of a vehicle, for example, in a rearview assembly such as a mirror assembly or in a dashboard or an infotainment center. Additionally or alternatively, controller 80 may be associated with a home security system 44 or an app or program on a smart phone, tablet, laptop computer, or other device. In some embodiments, internet-connected remote devices 42 (e.g., cell phones, tablets, smartphones, or other communication devices, or laptops, personal computers, and other devices) may function as a controller 80*d*. In some embodiments, controller 80 may be in communication with a device having a display screen, such as a rearview assembly in a vehicle, a smartphone, a tablet, or a laptop computer.

Controller 80 may provide information to user through at least one hardware component configured for providing an output. In some embodiments, the at least one hardware component may comprise a display screen 90, speaker, LEDs or other lights, or any other suitable hardware component. The information displayed or transmitted by controller 80 may include the status of overhead door 10 and error messages associated with overhead door 10.

Figure 3:
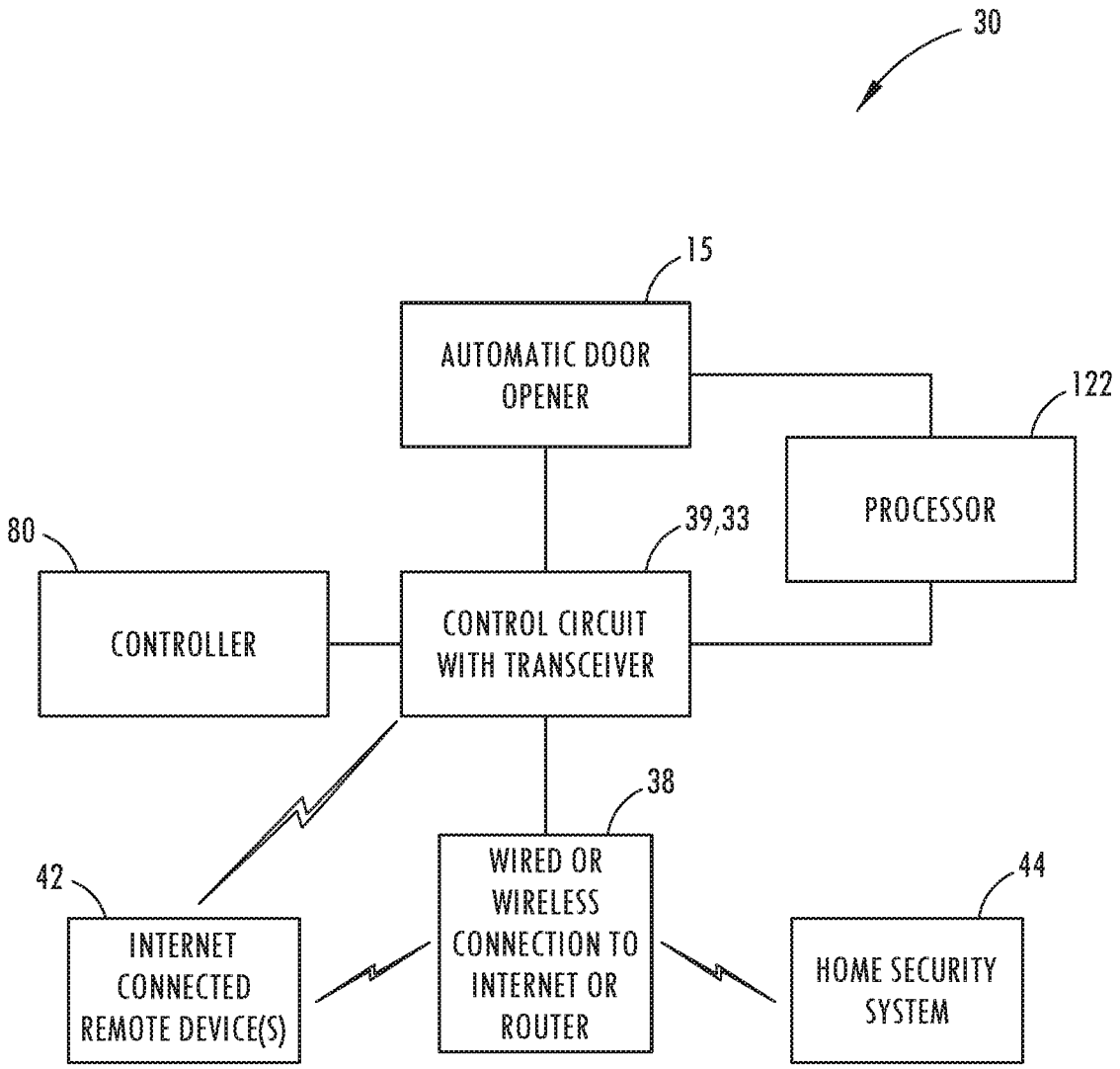
FIG. 3 is a diagram of the components of the overhead door control system.
Figure 4:
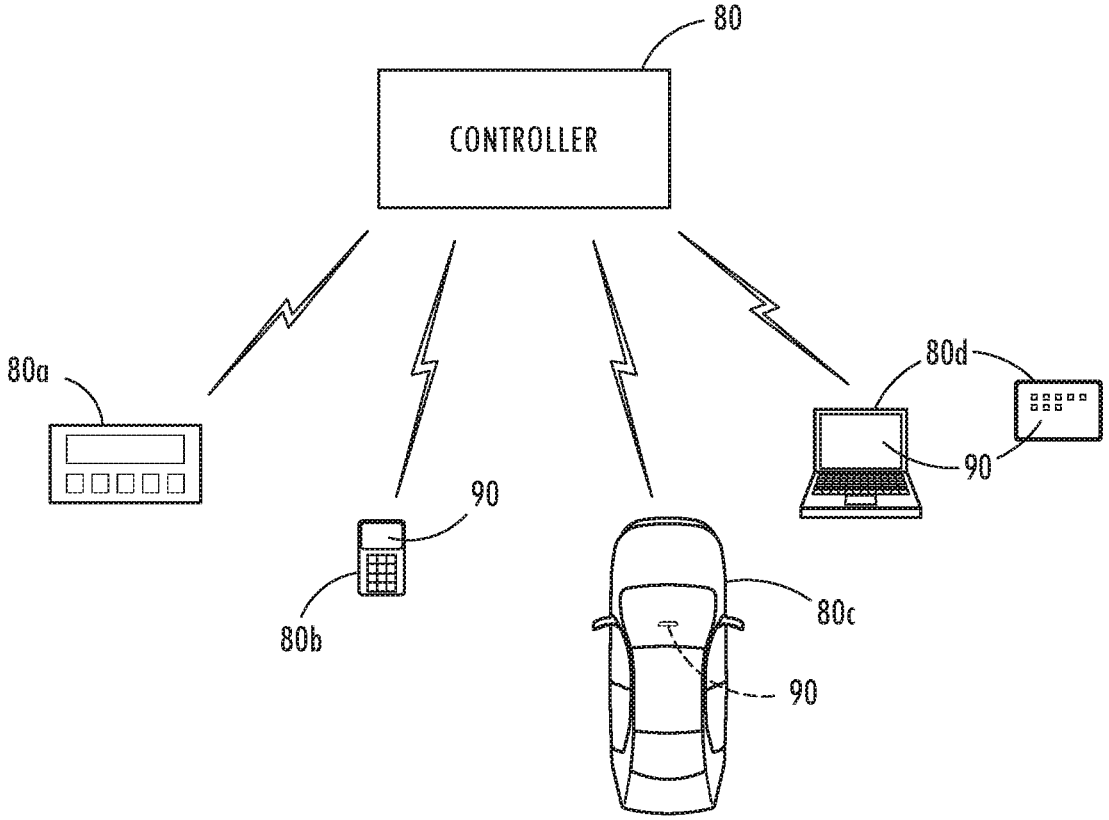
FIG. 4 is a schematic representation of communication flows.

Referring now to FIG. 3, a door control system 30 may include a control circuit 39 that may include a receiver or transceiver 33. In some embodiments, the transceiver 33 may communicate directly with internet-connected remote devices 42. Transceiver 33 may communicate wirelessly with control circuit 39, controller 80, automatic door opener 15, and internet-connected remote devices 42. The communication may be through optical communication, radio frequency communication, and/or a protocol such as Bluetooth communication. The network connected to the transceiver 33 may be a local network or the Internet and may employ local application or cloud based computing techniques.

Transceiver 33 may have two-way communication with internet-connected remote devices 42 and with controller 80, and may receive and transmit signals between controller 80, internet-connected remote devices 42, and control circuit 39. The signals may include instructions to open or close the overhead door, information about the status of the overhead door, or other diagnostic or status information, and error messages. The signals may cause controller 80 or internet-connected remote device 42 to display an image or produce an audible or haptic output. Signals may be transmitted wirelessly via WiFi, Bluetooth, or other wireless connection.

The transceiver 33 may also receive information from and/or transmit information to other devices configured to communicate with the transceiver. For example, transceiver 33 may receive information from a processor 122 associated with the door control system 30. In some embodiments, processor receives information from at least one sensor 115, and the at least one sensor 115 may be in communication with the motor 20 of the automatic door opener 15, or with any other suitable component of the door control system 30. The processor 122 may communicate with transceiver 33 wirelessly or through a wired connection.

In some embodiments, door control system 30 may optionally include a wired or wireless connection to an internet router 38, which may in turn allow communication with and control by internet-connected remote devices 42 as well as communication with a home security system 44. The connection to the internet router 38 may be a wired connection or it may be wirelessly connected to the router via WiFi, Bluetooth, or other wireless connection. The connection to the Internet may allow signals or other messages to be sent to or received from internet-connected remote devices 42, such as computers, smart phones, and tablets.

In some embodiments, automatic door opener 15 and door control system 30 may be accessed through a home internet gateway that is connected via conventional means to the Internet. Automatic door opener 15 may connect to home internet gateway via Bluetooth®, Bluetooth® Low Energy, WiFi, wired Ethernet or a special purpose wireless (RF) link. An example of such a system is Chamberlain MyQ® brand smartphone overhead opener.

In some embodiments, user may activate automatic door opener 15 through controller 80. In some embodiments, user may activate automatic door opener 15 through an internet-connected remote device 42. In some embodiments, the activation of the automatic door opener 15 may be triggered automatically based on the controller's proximity or position in relation to the overhead door.

The activation of automatic door opener may trigger controller 80 to send a signal to automatic door opener 15 to initiate the opening or closing of the overhead door 10, or to stop the opening or closing of the door if door is already in motion. Upon receipt of instructions to open or close the overhead door 10, motor 20 may begin moving screw, chain or belt 28, thereby causing the movement of trolley 40 along track 35. The movement of trolley 40 moves door arm 45 and that, in turn, initiates the movement of overhead door 10.

During operation of automatic door opener 15, if either a torsion spring 55 or an extension spring 100 breaks, motor 20 may not be able to lift overhead door 10. However, motor 20 may experience high demand even as overhead door 10 does not move or moves very little. If overhead door 10 is in an open position when a torsion spring 55 or an extension spring 100 breaks, motor 20 of automatic door opener 15 may not be able control the descent of the overhead door, yet would exhibit unusual demands. Sensor 115 may be configured to sense unusual demands on motor 20. Upon an indication that motor is experiencing unusual demands, sensor may be configured to communicate with processor. Processor may determine whether there is a possibility that spring 55, 100 has broken. Upon a determination that spring 55, 100 may have broken, processor may communicate that information to at least one of internet-connected devices 42 and controller 80.

At least one of controller 80 and internet-connected remote devices 42 may be configured to indicate a status of the overhead door, and to indicate an alert when sensor 115 senses unusual demands on motor 20. Alert may take the form of an audible signal, a display such as a text message or an icon, or other forms. The status and/or alert may also be displayed on a user interface accessible on a smart phone or internet-connected device.

Figure 5:
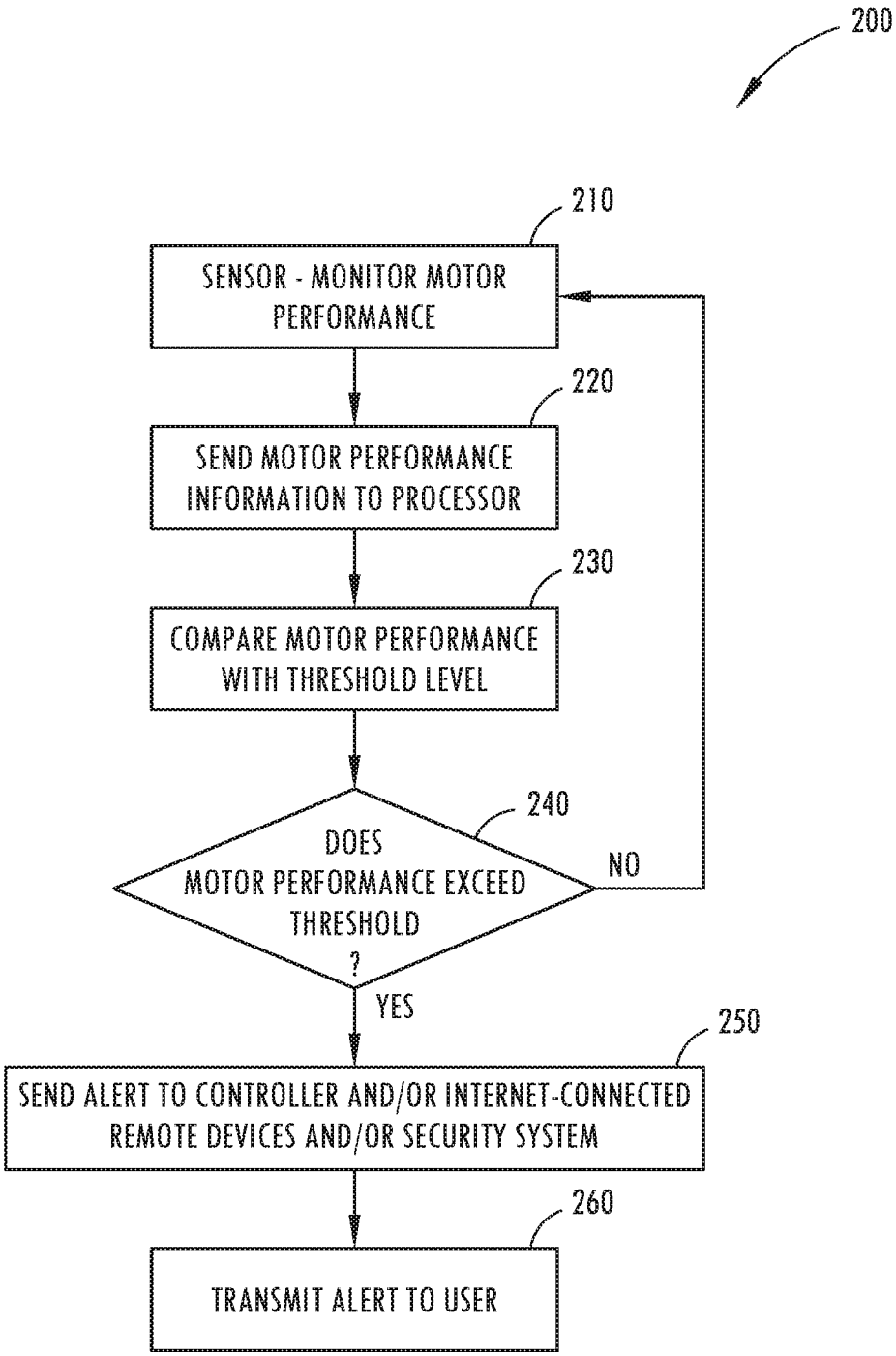
FIG. 5 is a flow chart of the process described herein.

Referring now to FIG. 5, a method 200 of diagnosing a broken spring and alerting a user begins with step 210, in which a sensor 115 may be configured to monitor motor usage. In some embodiments, sensor 115 may be configured to sense when motor 20 experiences unusual demands. Unusual demands on motor 20 may result from working too hard to lift overhead door 10 or from trying to restrain overhead door 10 from closing too fast. Sensor 115 may be in communication with processor 122. In step 220, sensor 115 may be configured to send information on the motor loading or current usage of motor 20 to processor 122. Processor 122 may be configured to compare the loading or current usage of motor 20 with a predetermined threshold level, as shown in step 230.

In step 240, if processor 122 determines that motor loading or current usage of motor 20 does not exceed the predetermined threshold level, returning to step 210, the sensor continues to monitor motor performance. In step 240, if processor 122 determines that motor loading or current usage of motor 20 does exceed the predetermined threshold level, processor 122 may send an alert, as shown in step 250. The alert may be sent to at least one of controller 80, internet-connected remote devices 42, and home security system 44. In some embodiments, the alert is transmitted using the same mode of communication and to the same device that triggers the operation of automatic door opener 15 when a user activates the door control system 30. For example, if the activation signal to activate door control system 30 comes from an in-vehicle controller 80*c*, sensor 115 may trigger in-vehicle controller 80*c* to display or sound the alert. Additionally or alternatively, the alert may be sent to a different device than that which triggered the operation of automatic door opener 15 when the user activated door control system 30. For example, in-vehicle controller 80*c* may be used to trigger the operation of automatic door opener 15, and alert may be sent to the user's cell phone via a text message.

In step 260, the alert is transmitted to the user. The alert may be visual, audible, haptic, or a combination of these. The alert may be transmitted to a plurality of devices; for example, the alert may be sent to controller 80, in a text or voice message to a user's cell phone, and in an email. If the alert is sent to controller 80 and if controller 80 includes a display screen 90, the alert may be visually displayed on display screen 90. In some embodiments, the alert may be in the form of an error code, or it may be a text message or an icon. In some embodiments, the alert may tell a user that an overhead door spring 55 may be broken. In some embodiments, the alert may be in text and may tell what the problem is, or it may be a pictorial message. The alert may also generate a separate message to user, such as a text message, an email message, or a voicemail or phone call. The alert may be sent wirelessly, through wi-fi or radio waves or Bluetooth, through wired or wireless internet, or through a combination of these.

In some embodiments, a device may receive an alert and transmit it to a separate device. For example, if controller 80 does not have a display screen, such as some wall-mounted or stand-alone control units, upon receipt of an alert, controller 80 may be configured to send a signal to a device having a display screen 90, such as a rearview assembly in a vehicle, a smart phone, or a tablet. The message may be sent through a smart phone app or directly via text or voice message to a user's phone.

In some embodiments, users may access the door control system 30 through a smart phone app. The alert may be sent through the app to a user's phone or tablet. An alert may appear on user's smart phone screen, and the alert may be accompanied by an audible signal, a vibration or both.

In some embodiments, a user may activate the door control system 30 through an in-vehicle controller 80*c*. The alert may be sent to user through at least one of an audible alert and a visual alert from the in-vehicle controller 80*c*. Additionally or alternatively, the alert may be sent through an alert app or application 80*d* on at least one internet-connected remote communication devices 42 such as a cell phone, a tablet, and a laptop computer. The alert on the internet-connected remote communication devices 42 may include at least one of an audible signal, a text message, and an email message. The alert may also include a haptic alert on at least one of the cell phone and tablet. The alert may additionally or alternatively include a text message or icon displayed on a rearview assembly or on a vehicle infotainment system.

In some embodiments, the alert may tell user how to ascertain whether a spring has failed. The instructions may include text or graphics that indicate where the user should look and what the user should look for. The instructions could also include pictures or graphics of at least one of intact springs and broken springs to enable the user to determine whether a spring is broken.

In some embodiments, controller 80 or internet-connected remote device 42 may display contact information for local contractors or repair shops that may be able to repair the spring. Controller 80 or internet-connected remote device 42 may present a user with a choice of contractors or repair shops to contact or it may provide user with an option of having the device contact a contractor or repair shop directly.

In some embodiments, upon the detection of motor performance that exceeds the threshold level, control circuit 39 may disable the ability of controller 80 to transmit instructions to open or close overhead door 10. In some embodiments, upon the detection of motor performance that exceed the threshold level, control circuit may disable the ability of automatic door opener 15 to respond to instructions to open or close overhead door 10.

While certain aspects of the present subject matter described herein have been shown and described, it will be apparent to those skilled in the art that changes and modifications may be made to what is described herein without departing from the subject matter of the present disclosure.

The above description is considered that of the preferred embodiments only. Modifications of the disclosure will occur to those skilled in the art and to those who make or use the disclosure. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

In this document, relational terms, such as "first" and "second," "right" and "left," "top" and "bottom," "front" and "back," and the like, are used solely to distinguish one entity or action from another entity or action, without necessarily requiring or implying any actual such relationship, order, or number of such entities or actions. These terms are not meant to limit the element which they describe, as the various elements may be oriented differently in various applications.

The invention claimed is:

1. A system for detecting breakage of a spring in overhead doors equipped with automatic door openers comprising:

an automatic door opener having a motor;

a sensor configured to monitor motor performance; and a processor in communication with the sensor and configured to:

compare motor performance to a predetermined threshold motor performance level; and communicate with a rearview assembly when motor performance exceeds the threshold performance level.

2. The system of claim 1, wherein the processor communicates wirelessly.

3. A system for detecting broken springs in overhead doors having automatic door openers with motors comprising:

an automatic door opener having a motor;

a sensor in communication with the motor and configured to monitor a load on the motor;

a processor in communication with the sensor and configured to compare the load on the motor with a predetermined threshold level and to cause a signal to be sent to a controller when the load on the motor exceeds the predetermined threshold level; and a rearview assembly comprising the controller and configured to display a message when the controller receives the signal indicating the motor loading has exceeded the predetermined threshold level;

wherein the processor is configured to communicate with the controller.

4. The system of claim 3, wherein the rearview assembly has a display screen; wherein upon receipt of the signal indicating that the motor loading has exceeded the predetermined threshold level a message is displayed on the display screen.

5. A method of sending an alert when a door spring breaks comprising the steps of:

providing a sensor configured to monitor performance of a door opener motor, and a processor in communication with the sensor;

monitoring the motor performance with the sensor;

comparing, by the processor, the motor performance with a predetermined threshold level; and causing, when the motor performance exceeds the predetermined threshold level, an alert to be generated and transmitted to a rearview assembly.

6. The method of claim 5, further comprising the step of displaying at least one of text and graphics to assist a user in diagnosing a cause of the motor performance exceeding the predetermined threshold level.

7. The method of claim 5, wherein the rearview assembly has a display screen; further comprising the step of displaying a message on the display screen when the controller receives the alert.

8. The method of claim 5, wherein the rearview assembly has a speaker; further comprising the step of providing, upon receipt of the alert, an audible signal through the speaker.

9. The method of claim 5, wherein a signal is sent in one of wirelessly, through wi-fi or radio waves, through Bluetooth, or through wired or wireless internet.

* * * * *